US009078499B1

(12) United States Patent
Brabec

(10) Patent No.: US 9,078,499 B1
(45) Date of Patent: Jul. 14, 2015

(54) NECKLACE TANGLING PREVENTION SYSTEM

(71) Applicant: Nina Brabec, Los Angeles, CA (US)

(72) Inventor: Nina Brabec, Los Angeles, CA (US)

( * ) Notice: Subject to any disclaimer, the term of this patent is extended or adjusted under 35 U.S.C. 154(b) by 207 days.

(21) Appl. No.: 13/676,589

(22) Filed: Nov. 14, 2012

(51) Int. Cl.
*A45C 11/16* (2006.01)
*A45C 11/00* (2006.01)
*A47F 7/02* (2006.01)

(52) U.S. Cl.
CPC .. *A45C 11/00* (2013.01); *A47F 7/02* (2013.01)

(58) Field of Classification Search
CPC ..... A45C 11/16; A47F 7/02; B65D 85/00
USPC ..... 206/6.1, 485, 566, 495
See application file for complete search history.

(56) References Cited

U.S. PATENT DOCUMENTS

| | | | | | |
|---|---|---|---|---|---|
| 2,237,086 | A | * | 4/1941 | Bruns | 206/306 |
| 3,346,187 | A | * | 10/1967 | Mueller | 239/33 |
| 3,378,136 | A | * | 4/1968 | Lubin | 206/6.1 |
| 4,296,157 | A | * | 10/1981 | Conti | 138/121 |
| 4,461,383 | A | | 7/1984 | Groff | |
| 4,697,436 | A | * | 10/1987 | Schmidt | 63/3 |
| 4,726,469 | A | * | 2/1988 | Farber | 206/493 |
| 4,939,778 | A | * | 7/1990 | Tomberlin | 379/438 |
| 5,211,284 | A | * | 5/1993 | Parks | 206/6.1 |
| 5,425,444 | A | | 6/1995 | Chapman | |
| 5,617,947 | A | * | 4/1997 | Momjian et al. | 206/6.1 |
| 5,833,052 | A | | 11/1998 | Diamond | |
| 5,971,612 | A | * | 10/1999 | McAuslan | 383/43 |
| 6,023,786 | A | * | 2/2000 | Burnett | 2/170 |
| D425,331 | S | | 5/2000 | Murray | |
| 7,789,224 | B2 | | 9/2010 | Diamond | |
| 8,668,080 | B1 | * | 3/2014 | Kazanchyan et al. | 206/6.1 |
| 2010/0236287 | A1 | * | 9/2010 | Summerford | 63/1.12 |

* cited by examiner

*Primary Examiner* — Steven A. Reynolds

(57) ABSTRACT

A necklace tangling prevention system has a collapsible hollow tube with a tube first end and a tube second end. The tube first end has a first aperture fluidly connected to a tube cavity and the tube second end has a second aperture fluidly connected to the tube cavity. The tube has a ribbed tube side wall. The tube is collapsible to less than fifty percent of its fully extended length. The system has a necklace securing member located on the tube first end. The necklace securing member has a gripping member located on an interior surface for gripping a necklace. The necklace is inserted through the necklace securing member into the tube.

1 Claim, 5 Drawing Sheets

NECKLACE TANGLING PREVENTION SYSTEM

BACKGROUND OF THE INVENTION

When storing necklaces, care must be taken to prevent the necklace from becoming tangled either with itself or with another necklace. This can be especially significant when travelling with several necklaces. The present invention features a necklace tangling prevention system to ensure the necklace is tangle free and ready for use.

SUMMARY

The present invention features a necklace tangling prevention system. In some embodiments, the system comprises a collapsible hollow tube having a tube first end and a tube second end. In some embodiments, the tube first end comprises a first aperture fluidly connected to a tube cavity and the tube second end comprises a second aperture fluidly connected to the tube cavity. In some embodiments, the tube comprises a ribbed tube side wail. In some embodiments, the tube is collapsible to less than fifty percent of its fully extended length.

In some embodiments, the system comprises a necklace securing member located on the tube first end. In some embodiments, the necklace securing member comprises a gripping member located on an interior surface for gripping a necklace. In some embodiments, for use, the necklace is inserted through the necklace securing member into the tube.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Following is a list of elements corresponding to a particular element referred to herein:

100 Necklace tangling prevention system
200 Tube
210 Tube first end
212 Tube first aperture

Figure 1:
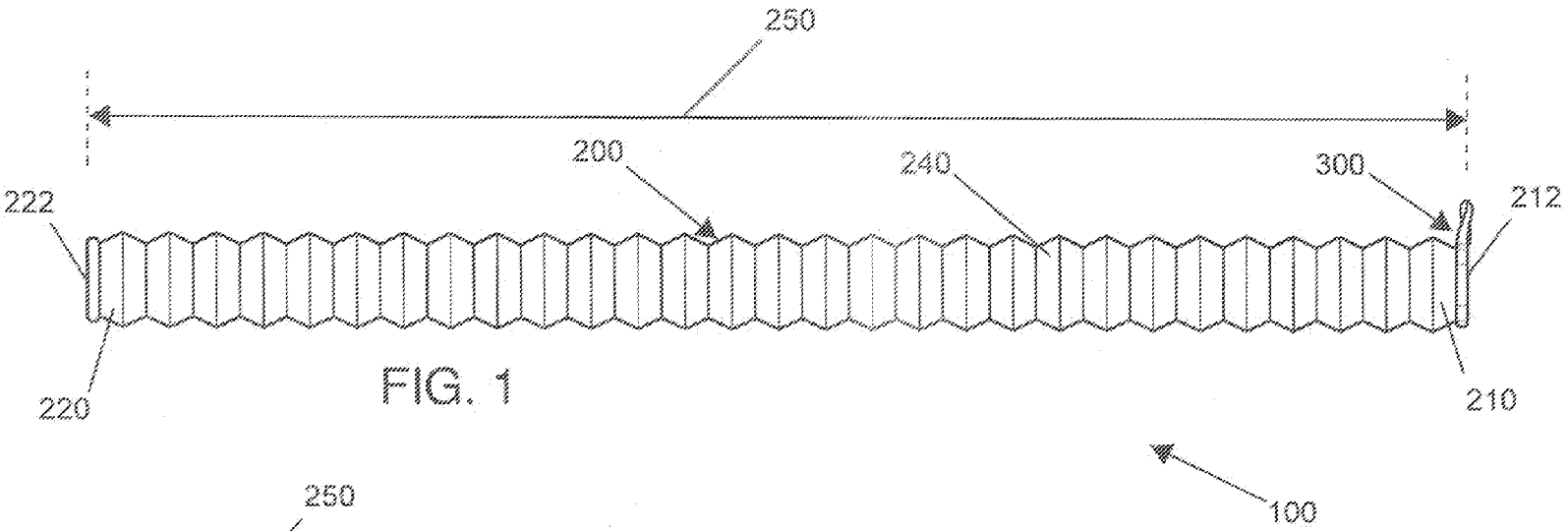
FIG. 1 is a side view of the present invention.
Figure 2:
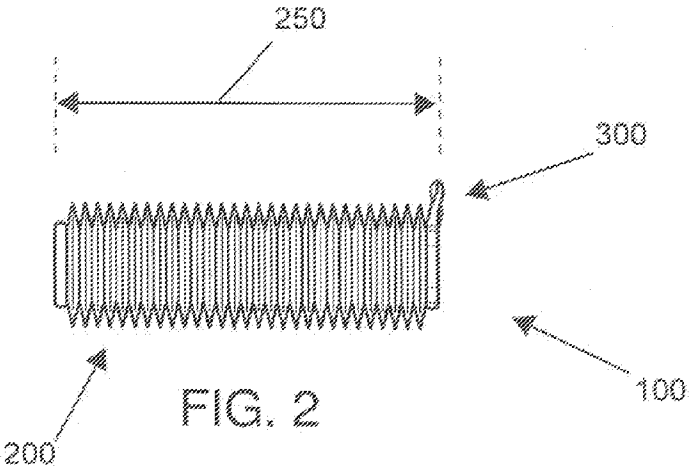
FIG. 2 is a side view of the present invention.
Figure 3:
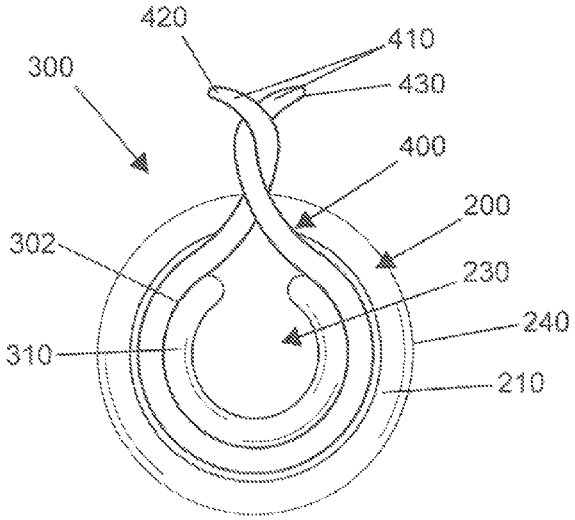
FIG. 3 is a front view of the necklace securing member of the present invention in a closed position.
Figure 4:
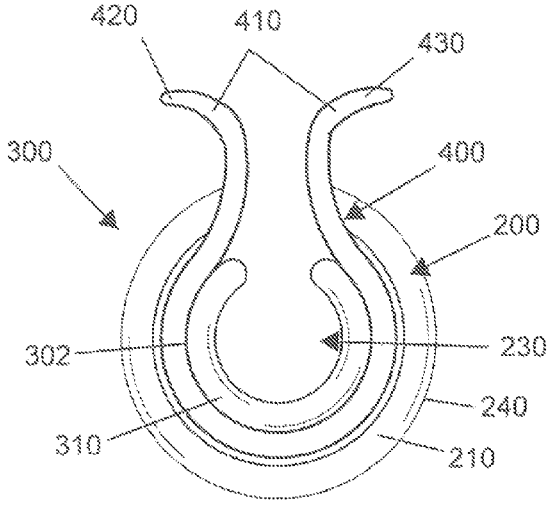
FIG. 4 is a front view of the necklace securing member of the present invention in an open position.
Figure 6:
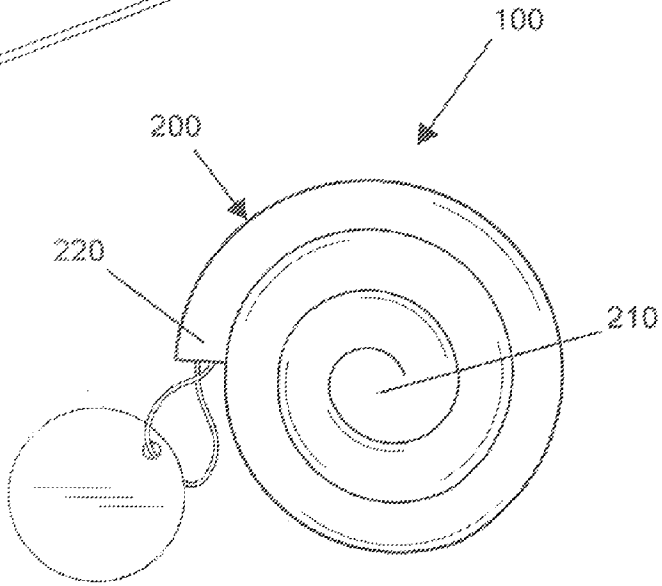
FIG. 6 is a side view of an alternate embodiment of the present invention.
Figure 5:
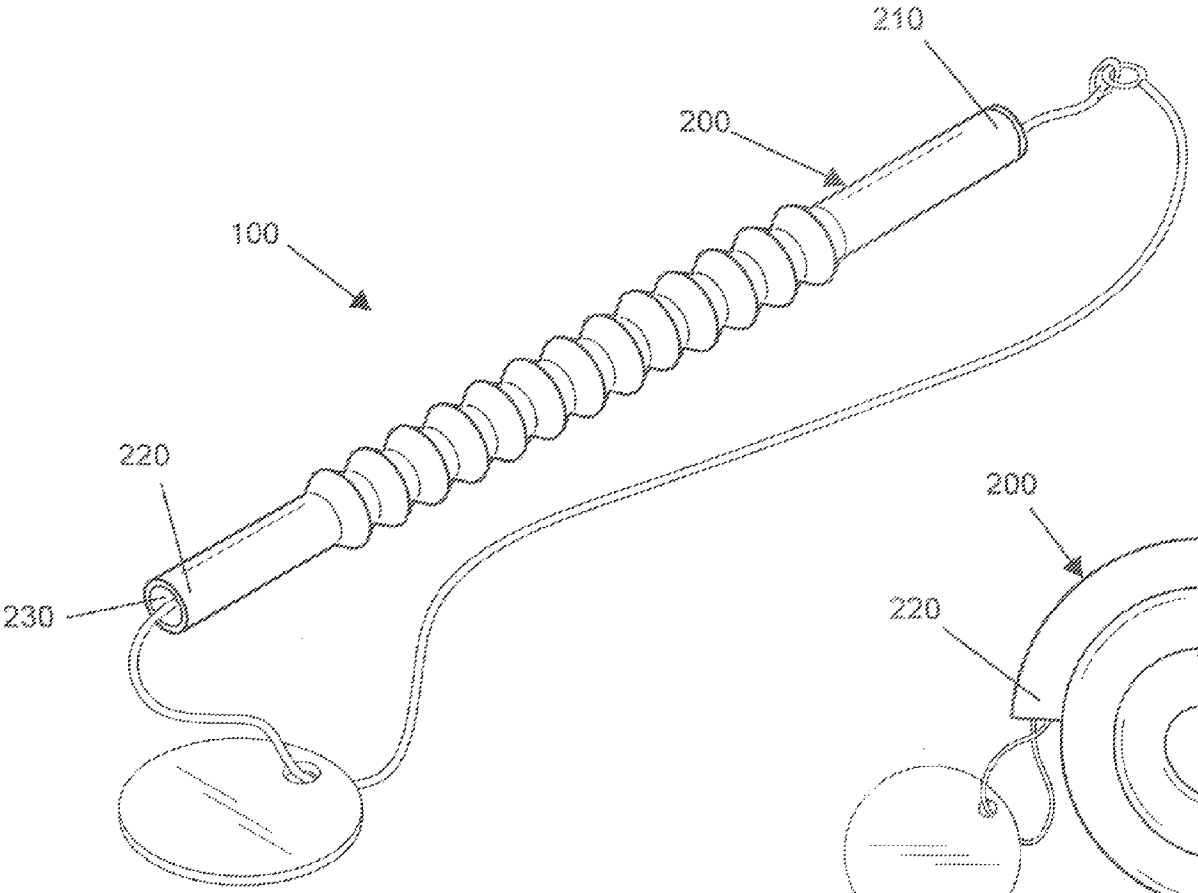
FIG. 5 is a perspective view of an alternate embodiment of the present invention.
Figure 7:
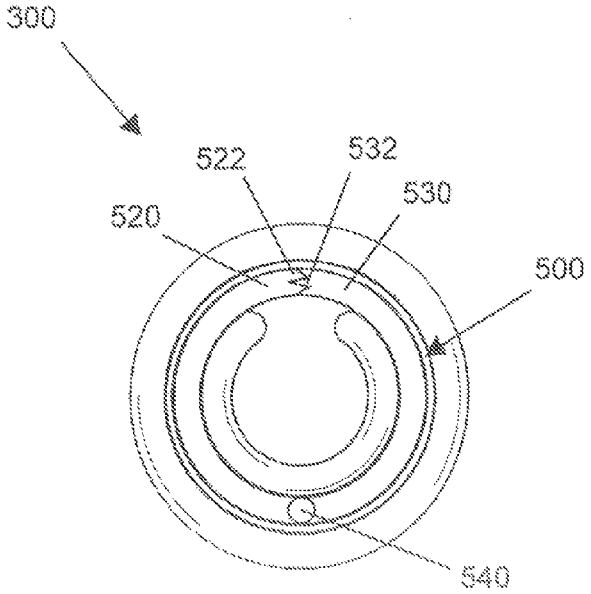
FIG. 7 is a front view of an alternate embodiment of the necklace securing member of the present invention.
Figure 8:
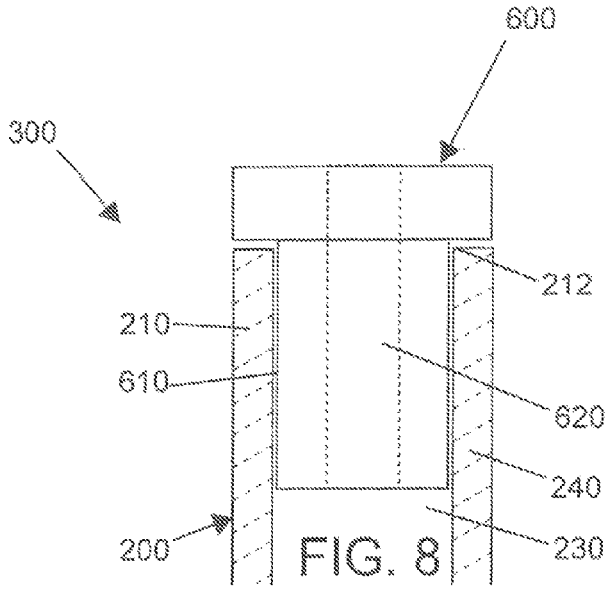
FIG. 8 is a side view of an alternate embodiment of the necklace securing member of the present invention.
Figure 9:
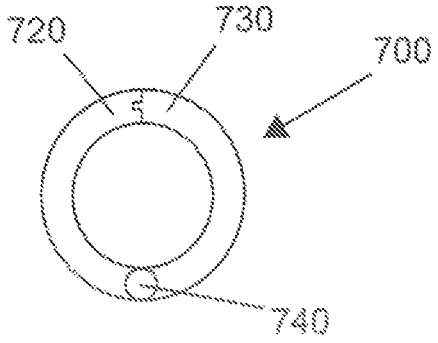
FIG. 9 is a front view of the necklace anchoring member of the present invention.

220 Tube second end
222 Tube second aperture
230 Tube cavity
240 Tube side wall
250 Tube length
300 Necklace securing member
302 Necklace securing member interior surface
310 Gripping member
400 Springed clip
410 Horn-like extension
420 First terminating clip end
430 Second terminating clip end
500 Pivoting ring
520 First terminating ring end
522 First locking component
530 Second terminating ring end
532 Second locking component
540 Pivoting component
600 Stopper
610 Stopper side
620 Slot
700 Necklace anchoring member
720 First anchoring member terminating end
730 Second anchoring member terminating end
740 Anchoring member pivoting means Referring now to FIG. 1-9, the present invention features a necklace tangling prevention system (100). In some embodiments, the system (100) comprises a collapsible hollow tube (200) having a tube first end (210) and a tube second end (220). In some embodiments, the tube first end (210) comprises a tube first aperture (212) fluidly connected to a tube cavity (230) located within the tube (200) and the tube second end (220) comprises a tube second aperture (222) fluidly connected to the tube cavity (230). In some embodiments, the tube (200) comprises a ribbed tube side wall (240). In some embodiments, the side wall (240) is not ribbed. In some embodiments, the tube (200) is collapsible to a tube length (250) of less than fifty percent of its fully extended tube length (250). In some embodiments, the tube (200) is collapsible in a similar manner to that of an accordion. In some embodiments, the tube (200) is collapsible for storage. In some embodiments, the tube (200) is collapsible to an optimum length for use with a necklace. In some embodiments, once collapsed, the tube (200) remains collapsed. In some embodiments, the tube (200) is partially collapsible, for example, it can be collapsed to a specific tube length (250).

In some embodiments, the system (100) comprises a necklace securing member (300) located on the tube first end (210). In some embodiments, the necklace securing member (300) comprises a gripping member (310) located on a necklace securing member interior surface (302) thereon for gripping a necklace. In some embodiments, the necklace securing member (300) holds the necklace into position. In some embodiments, the necklace securing member (300) keeps the necklace from dropping fully into the tube (200).

In some embodiments, for use, the tube (200) is extended to a fully extended tube length (250) for receiving a necklace. In some embodiments, the necklace is inserted through the necklace securing member (300) into the tube (200). In some embodiments, for storage, the necklace is removed from the tube (200). In some embodiments, the tube is collapsed to a tube length (250) of less than fifty percent of its fully extended tube length (250).

In some embodiments, the tube (200) is adapted to be rolled into a shape of a circular disk. In some embodiments, the tube (200) is adapted to be rolled into a shape of a circular disk and then be affixed into position.

In some embodiments, the tube (200) is constructed from silicone rubber. In some embodiments, the tube (200) is constructed from plastic.

In some embodiments, the necklace securing member (300) is a springed clip (400). In some embodiments, the clip (400) comprises a general shape of a ring having curved, horn-like extensions (410). In some embodiments, the clip (400) comprises a first terminating clip end (420) and a second terminating clip end (430). In some embodiments, the springed clip (400) comprises a general shape of an "omega" symbol.

In some embodiments, the first terminating clip end (420) comprises a general shape of a "U". In some embodiments, the second terminating clip end (430) comprises a general shape of a "U". In some embodiments, the first terminating clip end (420) faces away from the second terminating clip end (430).

In some embodiments, in a first open position, the first terminating clip end (420) does not contact the second terminating clip end (430). In some embodiments, the clip (400) is biased in the first open position. In some embodiments, in a second closed position, the first terminating clip end (420) hooks and interlocks with the second terminating clip end (430). In some embodiments, the clip (400) closes on the necklace to securely grip the necklace via the gripping member (310).

In some embodiments, the necklace securing member (300) is a pivoting ring (500). In some embodiments, the ring (500) comprises a first terminating ring end (520) having a first locking component (522) and a second terminating ring end (530) having a second locking component (532). In some embodiments, the ring (500) comprises a pivoting component (540) located opposite the first locking component (522) and the second locking component (532). In some embodiments, in a first open position, the first terminating ring end (520) does not contact the second terminating ring end (530). In some embodiments, in a second closed position, the first terminating ring end (520) interlocks with the second terminating ring end (530). In some embodiments, the ring (500) closes on the necklace to securely grip the necklace via the gripping member (310).

In some embodiments, the necklace securing member (300) is a stopper (600) having a slot (620) located on a stopper side (610) thereon. In some embodiments, the slot (620) is fluidly located from the stopper side (610) to a center of the stopper (600) therein.

In some embodiments, the system (100) comprises a necklace anchoring member (700). In some embodiments, the necklace anchoring member (700) resembles a mini clip having a hole located through a center therein. In some embodiments, the necklace anchoring member (700) comprises a first anchoring member terminating end (720), a second anchoring member terminating end (730), and an anchoring member pivoting means (740). In some embodiments, in a first open position, the first anchoring member terminating end (720) does not contact the second anchoring member terminating end (730). In some embodiments, in a second closed position, the first anchoring member terminating end (720) closes against and interfaces with the second anchoring member terminating end (730) to securely grip the necklace. In some embodiments, the necklace anchoring member resembles a bead that securely snaps around a central object. In some embodiments, the necklace anchoring member (700) is used as a weight to help pull the necklace into and through the tube (200).

In some embodiments, the gripping member (310) is constructed from silicone rubber. In some embodiments, the gripping member (310) is constructed from rubber.

As used herein, the term "about" refers to plus or minus 10% of the referenced number. For example, an embodiment wherein the tube is about 10 inches in length includes a tube that is between 9 and 11 inches in length.

The disclosures of the following U.S. Patents are incorporated in their entirety by reference herein: U.S. Pat. No. D 425,331; U.S. Pat. No. 7,789,224; U.S. Pat. No. 5,833,052; U.S. Pat. No. 5,425,444; U.S. Pat. No. 5,211,284; and U.S. Pat. No. 4,461,383.

Various modifications of the invention, in addition to those described herein, will be apparent to those skilled in the art from the foregoing description. Such modifications are also intended to fall within the scope of the appended claims. Each reference cited in the present application is incorporated herein by reference in it's entirety.

Although there has been shown and described the preferred embodiment of the present invention, it will be ready apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A necklace tangling prevention system (100), wherein said system (100) comprises:

(a) a collapsible hollow tube (200) having a tube first end (210) and a tube second end (220), wherein the tube first end (210) comprises a tube first aperture (212) fluidly connected to a tube cavity (230) disposed within the tube (200) and the tube second end (220) comprises a tube second aperture (222) fluidly connected to the tube cavity (230), wherein the tube (200) comprises a ribbed tube side wall (240), wherein the tube (200) is collapsible to a tube length (250) of less than fifty percent of its fully extended tube length (250); and (b) a necklace securing member (300) disposed on the tube first end (210), wherein the necklace securing member (300) comprises a gripping member (310) disposed on an necklace securing member interior surface (302) thereon for gripping a necklace;

wherein for use, the tube (200) is extended to a fully extended tube length (250) for receiving a necklace, wherein the necklace is disposed through the necklace securing member (300) into the tube (200), wherein, the necklace is removed from the tube (200), wherein the tube is collapsed to a tube length (250) of less than fifty percent of its fully extended tube length (250), wherein the necklace securing member (300) is a springed clip (400), wherein the clip (400) comprises a general shape of a ring having curved, horn-like extensions (410), wherein the clip (400) comprises a first terminating clip end (420) and a second terminating clip end (430), wherein the first terminating clip end (420) comprises a general shape of a "U", wherein the second terminating clip end (430) comprises a general shape of a "U", wherein the first terminating clip end (420) faces away from the second terminating clip end (430), wherein in a first open position, the first terminating clip end (420) does not contact the second terminating clip end (430), wherein the clip (400) is biased in the first open position, wherein in a second closed position, the first terminating clip end (420) hooks and interlocks with the second terminating clip end (430), wherein the clip (400) closes on the necklace to securely grip the necklace via the gripping member (310).

* * * * *